US008002133B2

(12) United States Patent
Galownia et al.

(10) Patent No.: US 8,002,133 B2
(45) Date of Patent: Aug. 23, 2011

(54) COLORANT CONTAINER

(75) Inventors: Joseph M. Galownia, New Albany, IN (US); Dennis Futo, Strongsville, OH (US); Dale Panascewicz, Strongsville, OH (US)

(73) Assignee: BASF Corporation, Florham Park, NJ (US)

( * ) Notice: Subject to any disclaimer, the term of this patent is extended or adjusted under 35 U.S.C. 154(b) by 1470 days.

(21) Appl. No.: 11/048,184

(22) Filed: Feb. 1, 2005

(65) Prior Publication Data

US 2005/0211660 A1 Sep. 29, 2005

Related U.S. Application Data

(60) Provisional application No. 60/556,814, filed on Mar. 27, 2004.

(51) Int. Cl.
*B65D 23/10* (2006.01)
*B65D 1/02* (2006.01)

(52) U.S. Cl. ..... 215/384; 215/398; 220/675; 220/771

(58) Field of Classification Search ..... 215/382, 215/384, 398, 383; 220/672, 771, 675, 671; D9/556, 569; 366/217.605
See application file for complete search history.

(56) References Cited

U.S. PATENT DOCUMENTS 2,115,654 A * 4/1938 Swofford ..... 215/12.1
2,685,316 A * 8/1954 Krasno ..... 206/524.8
D193,637 S * 9/1962 Ferraro ..... D9/556
3,229,841 A * 1/1966 Bailey ..... 215/42
3,537,498 A * 11/1970 St. Amand ..... 604/403
3,730,372 A * 5/1973 Komendowski ..... 215/47
3,923,184 A * 12/1975 Choksi et al. ..... 215/251
D241,416 S * 9/1976 Aul et al. ..... D9/520
4,576,843 A * 3/1986 Beck et al. ..... 428/36.92
4,900,500 A * 2/1990 Honeycutt ..... 264/263
5,092,474 A * 3/1992 Leigner ..... 215/381
5,320,231 A * 6/1994 Iodice ..... 215/385
5,732,838 A 3/1998 Young
5,758,790 A 6/1998 Ewing, Jr.
5,887,774 A * 3/1999 Bethune ..... 224/414
5,931,323 A * 8/1999 Wilkinson et al. ..... 215/228
6,095,360 A * 8/2000 Shmagin et al. ..... 215/382
6,213,326 B1 * 4/2001 Denner et al. ..... 215/383
6,228,317 B1 * 5/2001 Smith et al. ..... 264/521
D447,957 S * 9/2001 Lichtman et al. ..... D9/556
6,349,844 B1 * 2/2002 Betras ..... 220/709
6,390,316 B1 * 5/2002 Mooney ..... 215/384
6,520,362 B2 * 2/2003 Heisel et al. ..... 215/381
6,568,156 B2 * 5/2003 Silvers et al. ..... 53/440
6,612,451 B2 * 9/2003 Tobias et al. ..... 215/375
6,814,923 B2 * 11/2004 Bromley et al. ..... 264/536
6,983,862 B2 * 1/2006 Nottingham et al. ..... 222/109

(Continued)

OTHER PUBLICATIONS

Picture of "Blend-A-Color" plastic can, Sherwin Williams.

(Continued)

*Primary Examiner* — Sue A Weaver
(74) *Attorney, Agent, or Firm* — Raymond F. Keller

(57) ABSTRACT

A plastic container used to hold a dispersion-based paint colorant and capable of dispensing the colorant into paint dispensing machines, comprising an open top capable of holding and securing a cap, and having a wide mouth with a diameter of at least 50 mm. The plastic container has a cylindrical body extending below the open top, and a plurality of vertical ribs spaced around the body to strengthen the container.

8 Claims, 5 Drawing Sheets

U.S. PATENT DOCUMENTS

| | | | | |
|---|---|---|---|---|
| 7,178,687 | B1 * | 2/2007 | Manderfield et al. | 220/675 |
| 7,364,045 | B2 * | 4/2008 | Dygert et al. | 215/44 |
| 2001/0037992 | A1 * | 11/2001 | Tanabe et al. | 215/384 |
| 2002/0008106 | A1 | 1/2002 | Bezek et al. | |
| 2002/0017502 | A1 | 2/2002 | Renz | |
| 2003/0102340 | A1 * | 6/2003 | Walsh et al. | 222/572 |
| 2004/0173565 | A1 * | 9/2004 | Semersky et al. | 215/382 |

OTHER PUBLICATIONS

Leaversuch, Robert. "Close-Up on Technology—All-Plastic Paint Cans Challenge Steel." Plastics Technology Online,Oct. 2003. www.plasticstechnology.com/articles/200310cu1.html.

"Plastite Plastic Paint Can with Metal Ring and Plug." U.S. Can Company, 2003.

* cited by examiner

COLORANT CONTAINER

This application claims priority to Provisional Application U.S. No. 60/556,814, filed Mar. 27, 2004.

FIELD OF THE INVENTION

The present invention is directed to a novel container for the packaging of dispersion-based colorants to improve ease of use and efficiencies of preparing colorants for final dispensing in paint formulating centers.

BACKGROUND OF THE INVENTION

Currently, dispersion-based colorants, such as universal colorants, are packaged in quart metal cans. The metal cans require a variety of tools to be opened in order to fill colorant dispensers. Such colorant dispensers are used to provide one or more colorants to a base paint to provide a paint of a desired color. A common method used to open the metal cans of universal, dispersion-based colorant is with the use of a carpet knife and a "church key" type triangular can opener. This method of opening the cans has exposed those employees who formulate the paint for the individual consumer to potential injury. Additionally, both opening tools and methods of use leave small openings in the top of the can from which the colorant has to be poured. This results in slow addition time to the dispensers, does not allow the metal containers to fully empty, and does not allow for access to properly clean the containers for environmentally sound disposal.

In the daily filling of the colorant dispensers, a large number of quart containers are required. This process of refilling the dispensers requires a considerable time commitment. Typically, prior to filling the dispensers, the containers holding the colorant are shaken, such as in conventional paint mixing equipment, to mix and provide a uniform colorant. Mixing in such equipment takes about 3-5 minutes. If a full quart of colorant is not used, the containers are stored until the next day. There is no way to reseal the partially filled open containers, subjecting the containers to potential contamination, spillage, evaporation of components, and inability to remix. Upon completion of filling all dispensing canisters, all the quart cans are disposed of as normal waste. There is no ability to recycle.

"Plastics Technology—Online," October 2003, discusses new technology to replace the ubiquitous one-gallon metal paint cans used by professional painters and household consumers. From the article is described the Sherwin-Williams Dutch Boy "Twist and Pour" gallon plastic can, an extrusion blow molded HDPE container with a PP lid that is presently commercialized. This advance was reinforced by the introduction of a similar container by Masterchem, a supplier of primer paints that sells topcoats in gallon and quart HDPE cans. These plastic containers are square-bodied, rounded-lid, twist-top designs that fit more cans into available shelf space, a priority for mass retailers. The new plastic containers also incorporate ergonomic and convenience features for the predominantly female paint consumer, including injection molded handles and pour spouts, a recloseable screw cap that doubles as a paint cup, and color-coordinated labels that help consumers pick the right paint. However the new multi-part containers cost at least three times as much as the typical steel gallon can. Further, the new plastic paint containers fit awkwardly into the paint industry's current handling, filling, and tinting infrastructure designed for round steel cans.

In early 2004, two firms are to launch new all-plastic concepts for direct replacement of metal cans: an injection molded opaque, all-PP can developed by KW Plastics of Troy, Ala., and an injection stretch-blow molded clear, one-piece PET can from the PCC Group in the U.K. For about a decade, KW Plastics has supplied mass-market paint companies with millions of paint cans in a hybrid design that joins a PP body to a steel ring and lid. KW now plans to launch an all-PP paint can by mid-2004. The can body, ring, and lid will be of black, high-impact PP, though at first it will still have a snap-in metal handle. The can's crush-resistance reportedly exceeds that of metal cans and is sufficient to stack containers up to 25 units high. Called "Snap Lock," the two-part gallon can uses an injection molded black PP body similar to that of hybrid cans and a separate injection molded PP ring and lid. The shape of the can intentionally parallels that of the steel version so that it can fit easily into existing filling lines and in-store shaker equipment. Injection molded, snap-in PP pour spouts and handles are also in development.

The present applicants are not aware of any patents regarding alternative containers to address colorant handling issues. Sherwin-Williams offers colorant in a "F" style one-gallon plastic container. The "F" style container is a duplicate of a gallon anti-freeze container. In order for the colorant to be mixed, this container must be hand shaken. Those instructions are specified on the label. It appears that no provisions have been made for this container to be shaken with paint shaking equipment.

SUMMARY OF THE INVENTION

The present invention is directed to a new design for a family of dispersion-based colorant containers to address the key issues and objectives above. The design consists of a container extrusion blow molded from HDPE (high density polyethylene). The new container incorporates a wide opening having a diameter of at least 50 mm that allows for a removable and replaceable screw top closure. The design has the following advantages over the current metal quart containers in the marketplace: (1) requires no tools to open, (2) resealable, (3) speed of addition is improved with the wide opening. Tests have shown that the time required to add colorant to paint dispensers can be reduced over the current methods. For a quart container, pour times are reduced by 66-75% (10-15 seconds) per container. Additional advantages include: (4) the wide opening facilitates ease of cleaning the container for proper environmental disposal, (5) material of construction is a recyclable plastic.

Further, the container does not contain a separate handle that needs to be molded and/or attached to the container, but includes a hand grip area molded in the container to provide for a more secure grip, reducing potential for dropping containers and creating spills. The majority of metal containers in the marketplace are cylindrical in shape with no grip area. The plastic container of this invention is cylindrical and has a circular cross-section from top to bottom. The container incorporates a circumferential grip area of narrow cross-section on the outer container surface. The circular shape of the container allows for multiple case handling and shaking in current shaking equipment. A series of circumferentially spaced ribs in the hand grip area reinforces the container and renders the plastic container of this invention particularly useful in commercial paint mixers.

DETAILED DESCRIPTION OF THE INVENTION

In particular, the plastic containers of the present invention are used for storing dispersion-based colorants, such as universal colorants, generally containing over 10% pigment solids dispersed within a liquid vehicle, typically a mixture of surfactants, so as to maintain the pigment solids suspended in the liquid solution without separation. The containers of this invention are used to store and dispense the liquid colorants into paint dispensing machines which are used to make customized colors from a variety of paint bases. The containers of the present invention provide improvements in the daily filling of the colorant dispensers for paint formation, as previously described. Thus, ease of opening, being completely resealable, rapid filling speeds, easily cleaned for disposal and being recyclable are useful properties of the containers of this invention. Importantly, the plastic containers are provided with a strengthening feature so that the container can withstand the forces extended on the container during the typical mixing or shaking required to provide colorant uniformity.

Figure 1:
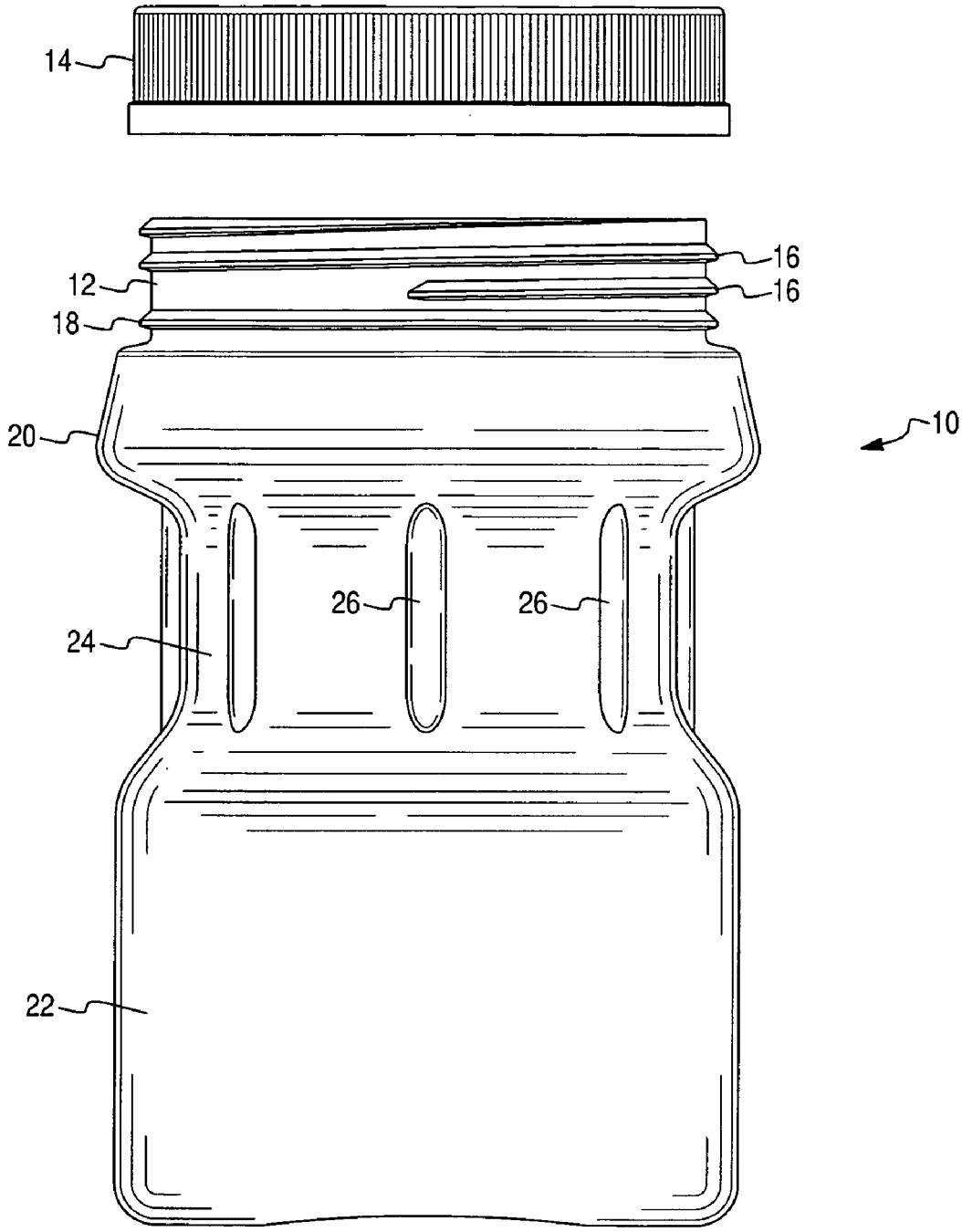
FIG. 1 is an exploded plan view of the container of this invention with cap.
Figure 2:
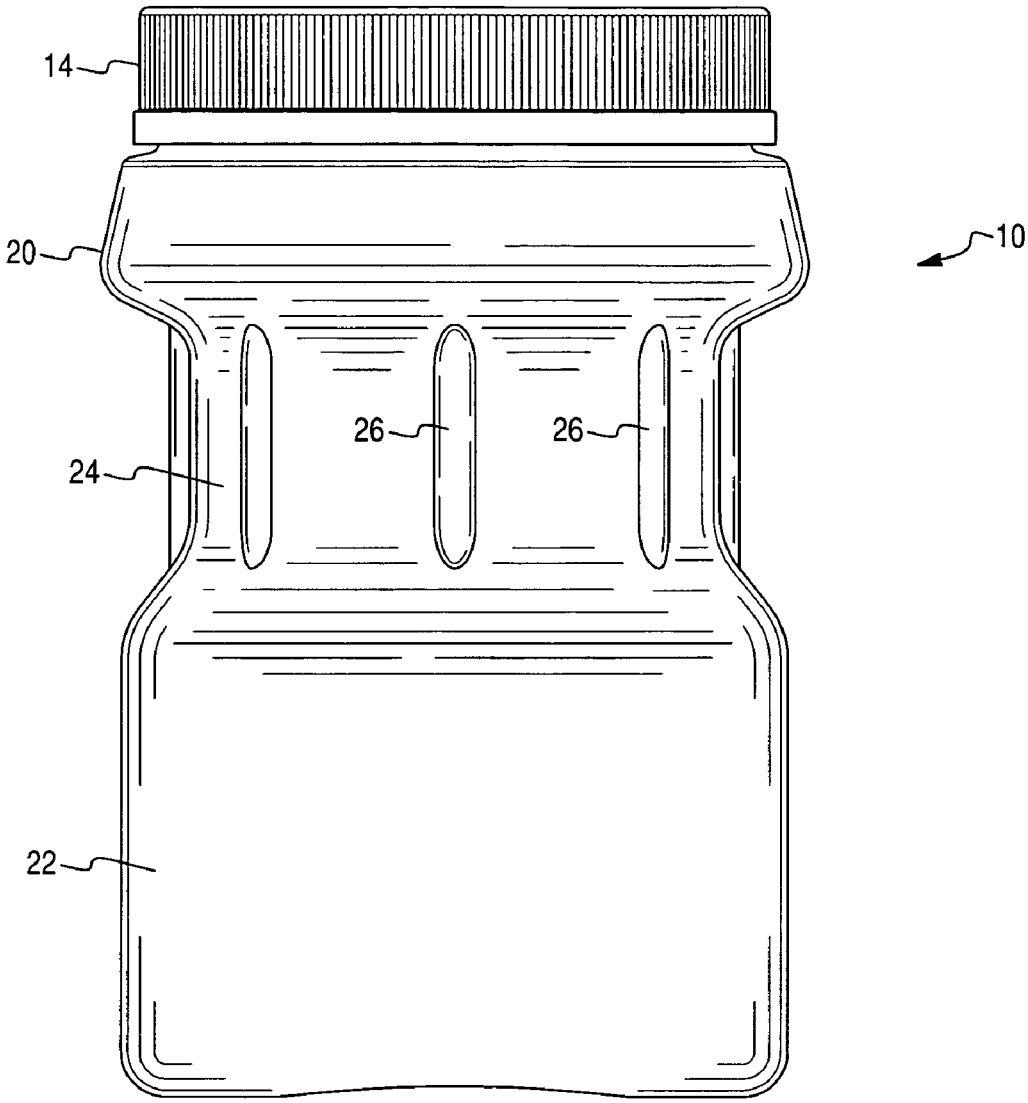
FIG. 2 is a plan view of the container of this invention with cap placed on the container.
Figure 3:
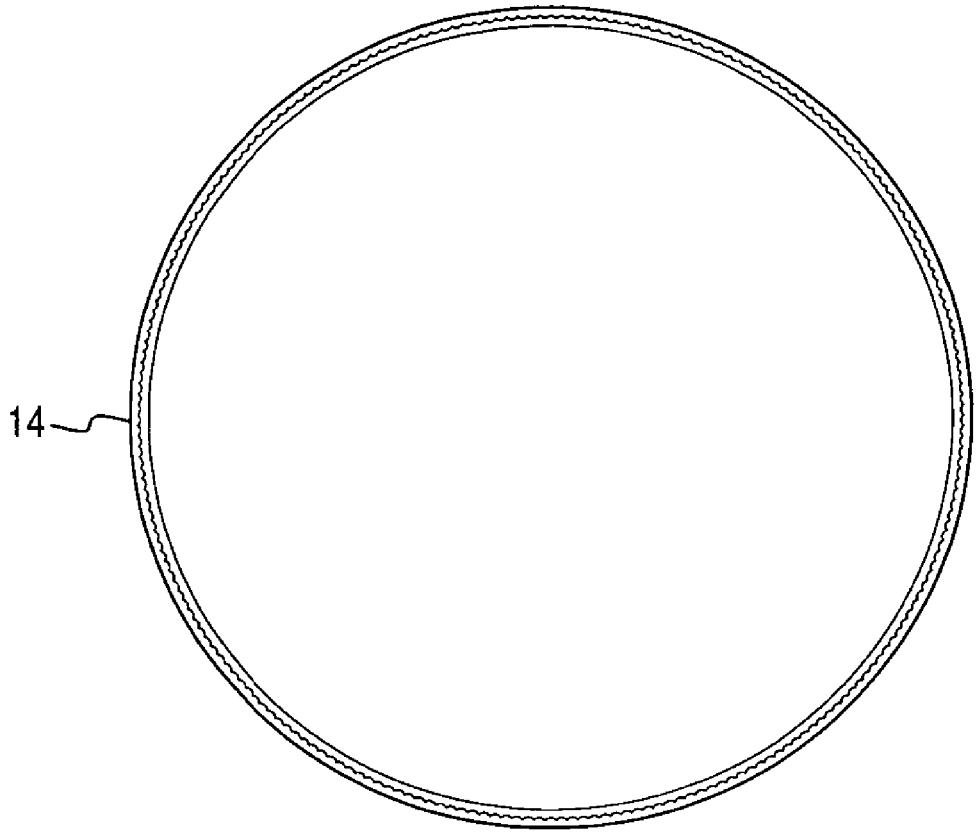
FIG. 3 is an end view of the top of the container without cap showing the circular cross-section.

An example of a paint container of the present invention is shown in FIGS. 1 and 2 and is designated in general by reference numeral 10. The container, for example in quart and one-half gallon size, is formed by extrusion blow molding from high density polyethylene (HDPE). The particular molding process for forming the paint container is not critical, and any known such method capable of forming the container 10 as described below can be used in this invention. Extrusion blow molding, a process well known in the art for forming hollow plastic structures such as containers, is particularly useful. While HDPE is preferred, the container configuration of this invention can be molded from other plastics such as polypropylene (PP) or polyethylene triphthalate (PET). It has been found that HDPE provides economic savings in that a container of desired thickness with sufficient strength can be formed. Referring to FIG. 1, container 10 has a top or neck 12 which is of circular cross-section, see FIG. 3. The neck 12 has a wide mouth of a diameter of at least 50 mm. Diameters of at least 60 mm are also useful and, in particular, diameters of from 70-100 mm or more are contemplated. The neck 12 can be sealed by a cap 14 and be configured so as to allow the continuous opening and closing of the cap 14 onto top 12 to dispense and effectively seal the contents within the interior of container 10. Snap-on tops are useful. Shown in FIG. 1 is a twist top in which spiral threads 16 on neck 12 match with threads contained with the interior of cap 14. As shown, the threads 16 include a circumferential thread 18, known as a security strip, which ensures that the cap 14 remains secure on neck 12, even in the event that container 10 is vigorously jostled or dropped.

From neck or top 12, container 10 contains a shoulder 20 which is of a greater diameter than neck 12. Shoulder 20 preferably has a circular cross-section throughout. However, other cross-section configurations are possible ranging from elliptical to rectangular and square. By maintaining a circular cross-section, it is believed the container of this invention fits more readily into known paint can handling equipment.

Figure 4:
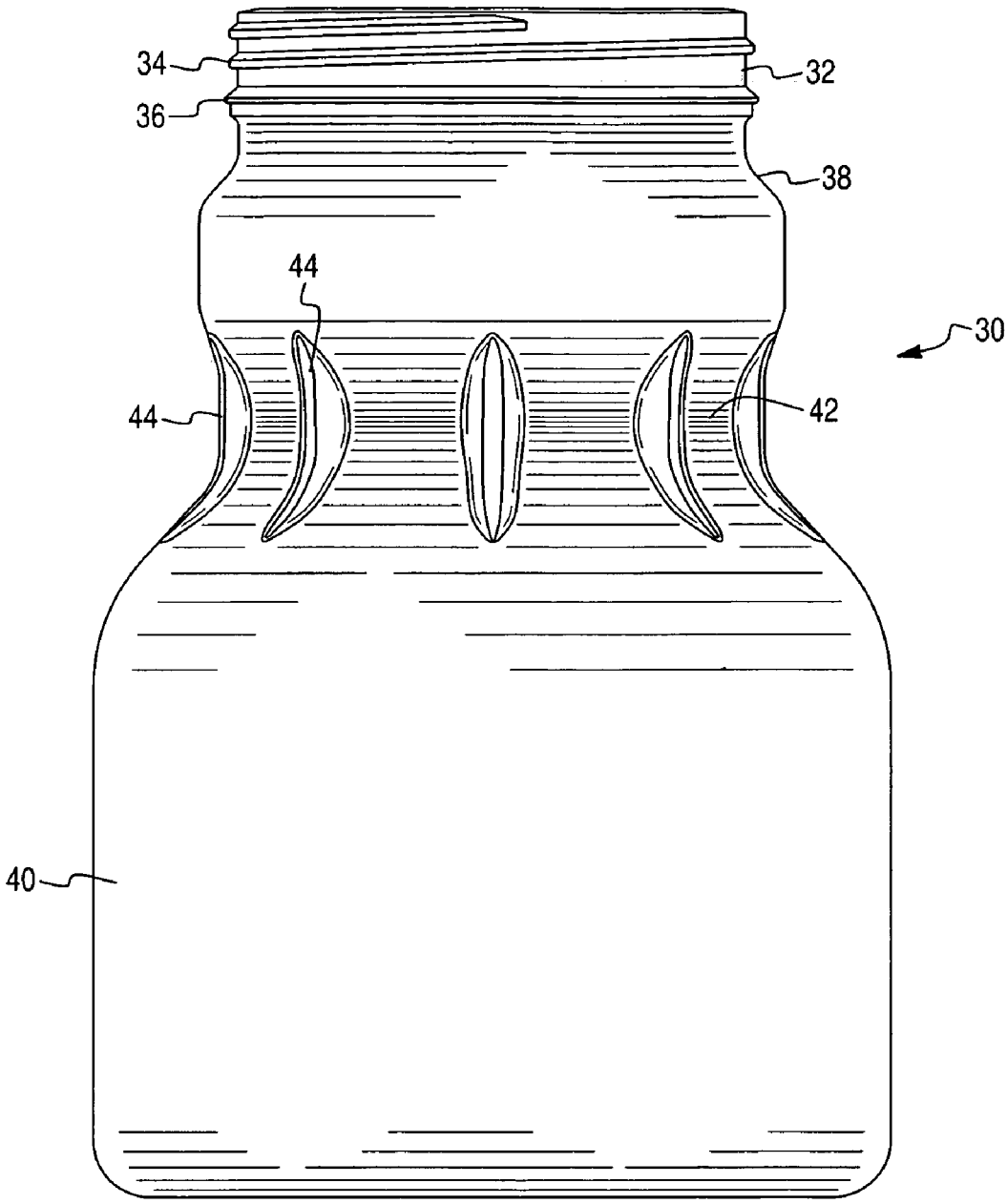
FIG. 4 is an alternative container to that shown in FIG. 1, in particular with respect to the shape of the circumferential shoulder.

In the configuration of shoulder 20 as shown in FIG. 1, shoulder 20 expands slightly from neck 12. Other configurations of the shoulder can be provided as shown in the container of FIG. 4. Below shoulder 20 is the cylindrical body 22 of container 10. The body 22 has a uniform outer wall and, again, is preferably of a circular cross-section substantially throughout. As above said regarding shoulder 20, body 22 may be provided with other than a circular cross-section, although such other configurations are not preferred. Positioned between shoulder 20 and body 22 is a circumferential gripping ring 24 in the form of a circumferential indention around container 10. The gripping ring has an outside diameter less than both the outside diameters of shoulder 20 and body 22, and allows the user to hold the container within their hand, typically between the thumb and forefinger. The container 10 does not contain any handle accessory which needs to be separately molded or separately formed and subsequently added to the container. Further, the container 10 of the present invention does not include any handle configuration that extends or protrudes laterally from the container. Thus, the mold for container 10 is of relatively simple construction and allows for relatively easy molding with a uniform thickness easy to obtain. The narrow diameter gripping ring 24 maintains the preferred circular cross-section of the container 10 of this invention from top to bottom, and allows the container 10 of this invention to be utilized in conventional paint can handling and shaking equipment. To strengthen container 10, the gripping ring 24 contains a plurality of vertical ribs 26 circumferentially spaced along and molded into gripping ring 24. The ribs 26 can be protrusions from the outer surface as shown or can be indentions as shown in the container illustrated in FIG. 5. The ribs 26 reinforce the strength of container 10 and, in particular, provide the strength necessary to withstand the vigorous shaking which takes place in conventional paint mixing equipment.

FIG. 4 illustrates another example of a plastic container within the scope of the present invention and which is very similar to container 10 as shown in FIG. 1. As shown in FIG. 4, the plastic container which is generally indicated by reference numeral 30, and typically in a quart or one-half gallon size, is formed by extrusion blow molding from the plastic materials as used to form container 10 and described previously. Container 30 contains a neck 32, which is preferably of a circular cross-section. Neck 32 has a mouth of the same diameter as discussed with respect to container 10. Neck 32 can be sealed by a cap, which is not shown, and can be configured so as to allow the continuous opening and closing of a cap onto the neck 32 to dispense and effectively seal the contents within the interior of container 30. While snap-on tops can be used as, shown in FIG. 4, neck 32 contains spiral threads 34, which would match the threads contained in the interior of a cap. Neck 32 also includes a circumferential thread 36, known as a security strip equivalent to security strip 18, as shown in FIG. 1. The security strip ensures that any cap that is enclosed around neck 32 remains secure in place in the event that the container 30 is vigorously shaken or dropped.

From neck 32, container 30 contains a shoulder 38 that is of a greater diameter than neck 32. Shoulder 38 preferably has a circular cross-section throughout. A particular difference between container 30 and container 10 of FIG. 1 is the shape of the shoulder 38. Thus, the shoulder 38 is of a rounded or vertical shape as compared to shoulder 20 of container 10, in which the shoulder expands slightly from the neck. The exact outer shape of the shoulder 38 is not of particular criticality to the present invention.

Below shoulder 38 is a cylindrical body 40 of container 30. Body 40 has a uniform outer wall and, again, is preferably of a circular cross-section substantially throughout. Body 40 may be provided with other than a circular cross-section, although such other configurations are not preferred. Positioned between shoulder 38 and body 40 is a circumferential gripping ring 42 in the form of a circumferential indention around container 30. The gripping ring has an outside diameter less than both the outside diameters of shoulder 38 and body 40, and is equivalent to the gripping ring 24 of container 10, shown in FIG. 1. The gripping ring allows the user to hold the container in one hand, typically between the thumb and the forefinger, and wherein the shoulder 38 abuts the top of the hand surface. Like container 10, container 30 does not contain any handle accessory which needs to be separately molded or separately formed and subsequently attached to the container. Further, container 30 does not include any handle configuration that extends or protrudes laterally from the container. Such shape allows for the mold of container 30 to be of a simple construction. Moreover, the shape of the container allows it to be readily placed into conventional paint mixing equipment and shaken vigorously without disrupting any lateral handle configurations.

Container 30 also contains a series of circumferentially spaced ribs 44 molded into the gripping ring 42. As shown in FIG. 4, the ribs 44 are protrusions from the outer surface of container 30, but can be indentions in which the ribs would extend from the inward surface of the container. The ribs 44 greatly strengthen the plastic container 30 and allow the plastic container to be vigorously shaken in paint mixing equipment without destruction of the container structure.

Figure 5:
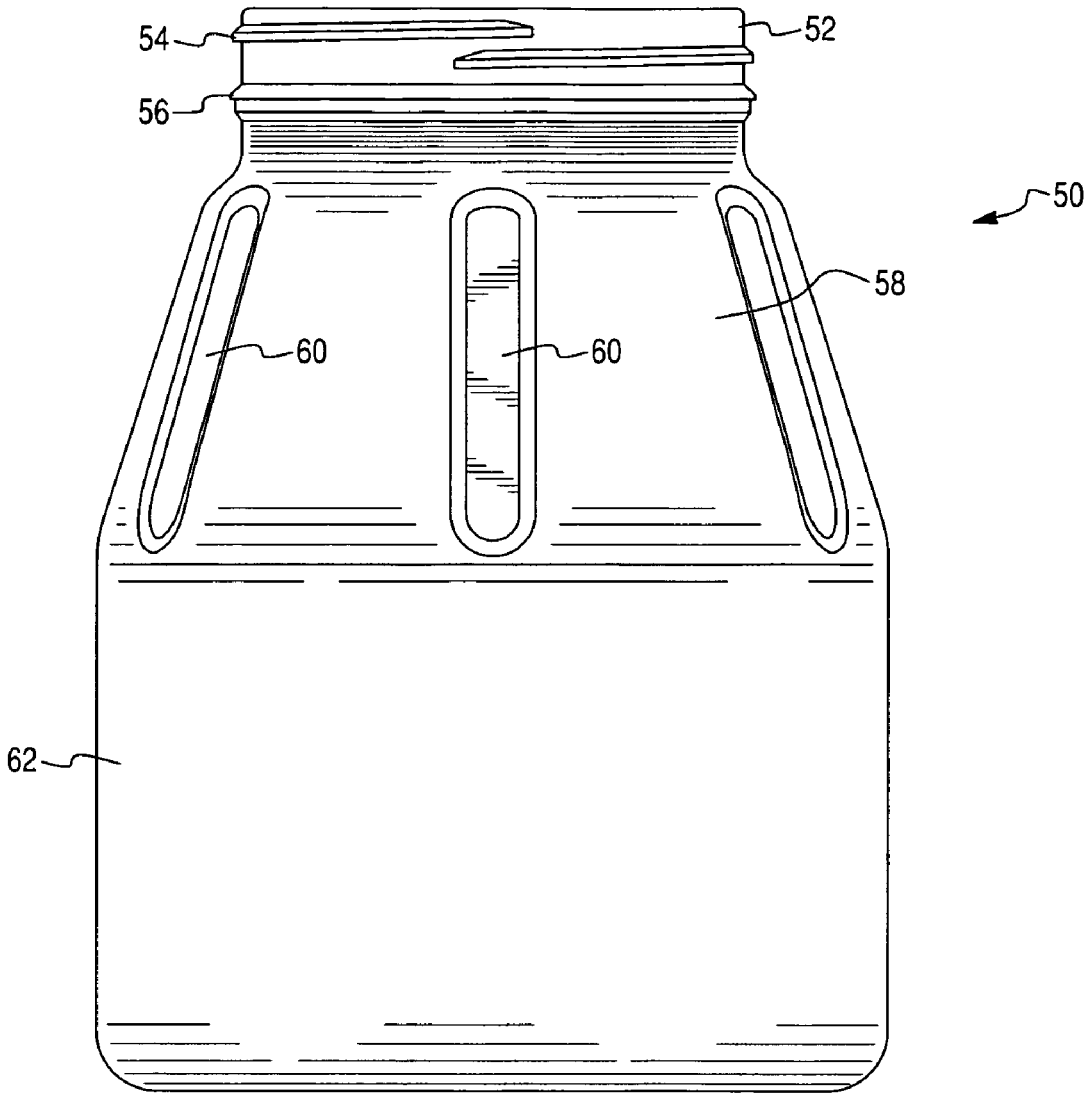
FIG. 5 is a plan view of another alternative container within the scope of this invention.

In FIG. 5 is shown still another alternative plastic container within the scope of the present invention. In FIG. 5, the plastic container is generally indicated by reference numeral 50, and can be formed of the same plastic materials such as high-density polyethylene, polypropylene, and polyethylene terephthalate, as previously described. Again, container 50 can be formed by any known molding technique, although extrusion blow molding would be a particularly useful method of forming the container. Container 50 contains a neck 52, which can be sealed by a cap not shown by means of threads 54 placed on the neck 52, and which would match threads that would be contained in the inside of any cap. A security strip 56 is also shown, and would allow the twist-on cap to be secured to the neck 52 and container 50, in the event that container 50 is vigorously shaken, such as in the paint mixing equipment as known, or accidentally dropped. The hand gripping portion of container, 50 indicated by reference numeral 58, is not formed by a circumferential indented ring, as in containers 10 and 30. Importantly, however, the hand grip portion 58 of container 50 contains a plurality of circumferentially-spaced ribs 60, which greatly increase the strength of the plastic container and allow it to be used in the conventional paint mixing equipment, and still maintain the integrity of the container during the vigorous shaking in such equipment. The ribs 60, as shown in FIG. 5, are indentions, or in other words, protrude from the interior surface of the container. It is understood that the ribs 60 can be in the form of the indentions as shown or protrusions from the outer surface as shown by ribs 26 and 44 in FIGS. 1 and 4, respectively.

Below the hand grip portion 58 is a body portion 62. The body 62 generally has a uniform outer wall and is preferably of a circular cross-section substantially throughout. Likewise, the hand grip portion 58 and the neck 52 are all preferably of circular cross-section. The gripping portion 58 of container 50 can expand from neck 52 to body portion 62, although the exact configuration of the gripping portion 58 is not particularly critical. What is most useful is that the plastic container is provided with a series of the spaced ribs 60 to provide the necessary strength for the plastic container to withstand the vigorous forces that are placed in the container during the paint mixing step.

EXAMPLE 1

In this example, the pouring speeds of colorant from plastic containers of this invention in quart and ½ gallon sizes were compared to that of the typically used quart metal cans.

POUR TEST

| Container | % Material Left in Can | Pour Time to Thin Stream | Pour Time to Drip |
|---|---|---|---|
| Quart Can (2 holes with church key) | 3.9-4.2 | 15-20 sec | ~35 sec |
| Quart Can (no lid)[1] | 3.1 | ~5 sec | ~20 sec |
| New Quart (no lid)[2] | 3.3-3.6<br>After Scraping Out: 2.2-2.4 | ~5 sec | 20-25 sec |
| New ½ Gal (no lid)[2] | 2.1-2.6<br>After Scraping Out: 1.7-2.2 | <10 sec | 35-70 sec |

[1]4 inch diameter opening
[2]89 mm (3.5 inch) diameter opening

Due to the larger opening than the two holes from a church key can opener pour times were reduced 65-75% (10-15 seconds) per container with the quart container of this invention. The larger opening allows additional material to be recovered using a rubber kitchen spatula. Wasted material is significantly reduced using the ½ gallon container when compared to two of the existing quart cans. Residual colorant was reduced by an average of 1.7%. With roughly 60 seconds of scraping, an additional 0.4% could be recovered. Pour time for the ½ gallon container was less than 10 seconds to empty the container to a thin stream. Pour times on an equivalent basis for two quart cans were up to four times longer (40 seconds, not including time for opening the can versus 10 seconds for the ½ gallon).

Without scraping, a yield improvement of 1.7% on the high volume colorants in the ½ gallon containers equates to hundreds of thousands of dollars in annual savings realized by the customer. Savings in employee costs are also realized from faster pour times on the quart container using a 10 second per container reduction in pour time and from the faster pour times on the ½ gallon container (10 seconds vs. 35 seconds) per container.

What is claimed is:

1. A plastic container for holding a paint colorant and for filling paint dispensers comprising a circular open top capable of closure by a separate cap and a body extending from below said open top, said circular top having a diameter of at least 50 mm, wherein said container further includes a shoulder extending from said open top to said body, and wherein said shoulder has a greater diameter than said open top and said cap, said container being devoid of a separately attached handle or any handle portion which extends laterally outward from said container, and wherein said container further includes a gripping portion comprising greater than four vertical gripping ribs spaced circumferentially apart for reinforcing said plastic container, wherein said gripping portion is in the form of a reduced diameter circumferential ring disposed between said shoulder and said body, both said shoulder and said body have circular cross-sections throughout, and said container is formed from high-density polyethylene.

2. The plastic container of claim 1 having an internal volume of ½ gallon.

3. The plastic container of claim 1 having an internal capacity of 1 quart.

4. The plastic container of claim 1 wherein said open top has a spiral thread capable of holding a twist-on cap which has matching internal threads.

5. The plastic container of claim 1 wherein said open top has a diameter of at least 60 mm.

6. The plastic container of claim 1 wherein said open top has a diameter of from about 70-100 mm.

7. The plastic container of claim 1 wherein said vertical gripping ribs protrude from an outer surface of said gripping portion.

8. The plastic container of claim 1 wherein said vertical gripping ribs are indented from the outer surface of said gripping portion.

* * * * *